US008239969B2

(12) United States Patent
Fisher

(10) Patent No.: US 8,239,969 B2
(45) Date of Patent: Aug. 14, 2012

(54) GLOVE INCORPORATING A SILICONE MATERIAL

(75) Inventor: Sam Fisher, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 872 days.

(21) Appl. No.: 12/255,474

(22) Filed: Oct. 21, 2008

(65) Prior Publication Data

US 2010/0095428 A1 Apr. 22, 2010

(51) Int. Cl.
*A41D 19/00* (2006.01)

(52) U.S. Cl. ..... 2/161.1

(58) Field of Classification Search ..... 2/16, 20, 2/161.1, 161.6

See application file for complete search history.

(56) References Cited

U.S. PATENT DOCUMENTS

| | | | | |
|---|---|---|---|---|
| 5,136,725 | A * | 8/1992 | Montero | 2/16 |
| 5,598,582 | A | 2/1997 | Andrews | |
| 5,673,437 | A * | 10/1997 | Chase et al. | 2/167 |
| 5,774,896 | A * | 7/1998 | Hochmuth | 2/161.1 |
| 5,911,926 | A * | 6/1999 | Harada et al. | 264/41 |
| 6,339,845 | B1 | 1/2002 | Burns | |
| 6,408,442 | B1 * | 6/2002 | Kang | 2/167 |
| 6,618,860 | B1 | 9/2003 | Sullivan | |
| 6,625,815 | B2 | 9/2003 | Litke | |
| 6,654,964 | B1 | 12/2003 | Staihar | |
| 6,701,529 | B1 * | 3/2004 | Rhoades et al. | 2/2.5 |
| 6,704,939 | B2 | 3/2004 | Faulconer | |
| 6,928,658 | B2 * | 8/2005 | Taira et al. | 2/161.6 |
| 7,000,257 | B2 * | 2/2006 | Bevier | 2/159 |
| 7,254,840 | B2 * | 8/2007 | Hammons et al. | 2/16 |
| 2003/0188373 | A1 | 10/2003 | Garneau | |
| 2007/0148409 | A1 | 6/2007 | Rios | |

FOREIGN PATENT DOCUMENTS

| | | |
|---|---|---|
| WO | 2004050343 | 6/2004 |

* cited by examiner

*Primary Examiner* — Katherine Moran
(74) *Attorney, Agent, or Firm* — Plumsea Law Group, LLC

(57) ABSTRACT

A glove for receiving a hand has a dorsal side corresponding with a back area of the hand and an opposite palmar side corresponding with a palm area of the hand. An exterior surface of the palmar side may include a polymer foam material with a silicone coating. Although the chemical composition of the silicone coating may vary significantly, the silicone coating may be a cured silicone film layer with a Shore A durometer of less than or equal to 60.

11 Claims, 13 Drawing Sheets

GLOVE INCORPORATING A SILICONE MATERIAL

BACKGROUND

The sport of soccer (also referred to as football or fútbol) generally involves maneuvering a soccer ball into a goal that is protected by players from an opposite team. Whereas a goalkeeper may utilize their hands to pick-up, carry, and throw the soccer ball, other players are prohibited from using their hands to direct movement of the ball. The hands of a goalkeeper are susceptible to injury when gaining control of the soccer ball, particularly when the ball is traveling at a relatively high velocity or when other players are attempting to kick or otherwise maneuver the ball. In order to provide protection for the hands, many goalkeepers wear protective gloves. A conventional glove for a soccer goalkeeper includes a polymer foam layer (e.g., natural latex foam) that provides protection to the hands and grip for the soccer ball.

SUMMARY

A glove for receiving a hand is disclosed below. The glove has a dorsal side corresponding with a back area of the hand and an opposite palmar side corresponding with a palm area of the hand. An exterior surface of the palmar side may include a polymer foam material with a silicone coating.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of a glove incorporating a silicone material. Although the glove is discussed and depicted as having the configuration of a soccer goalkeeper glove, concepts associated with the glove may be applied to various types of athletic gloves. In addition to a soccer goalkeeper glove, therefore, concepts discussed herein may be applied to hockey gloves, ski gloves, and weightlifting gloves, for example. In addition, concepts discussed herein may be applied to various types gloves used for generally non-athletic purposes (e.g., work gloves, welding gloves, oven mitts).

Figure 1:
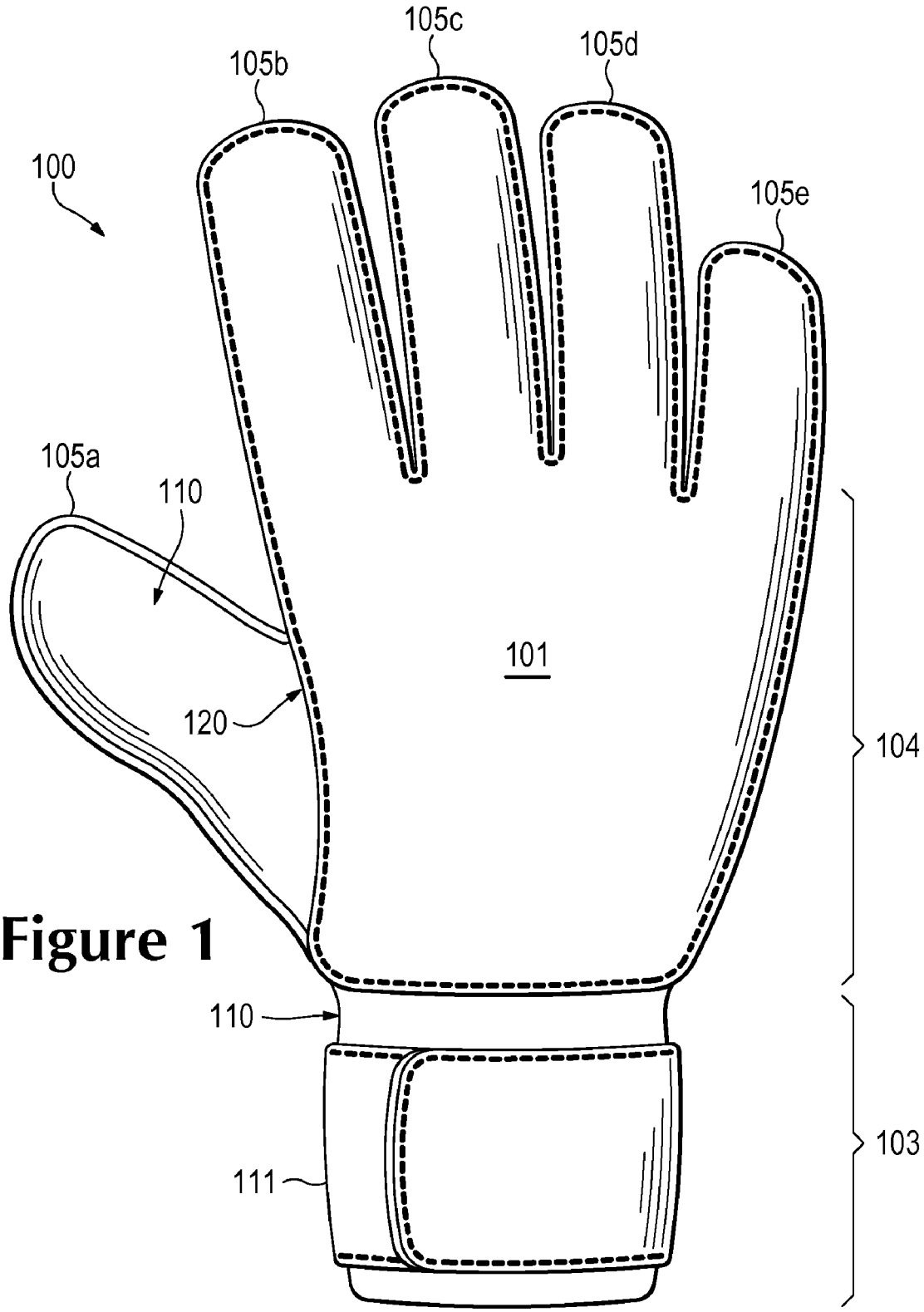
FIG. 1 is top plan view depicting a dorsal side of a first glove.
Figure 2:
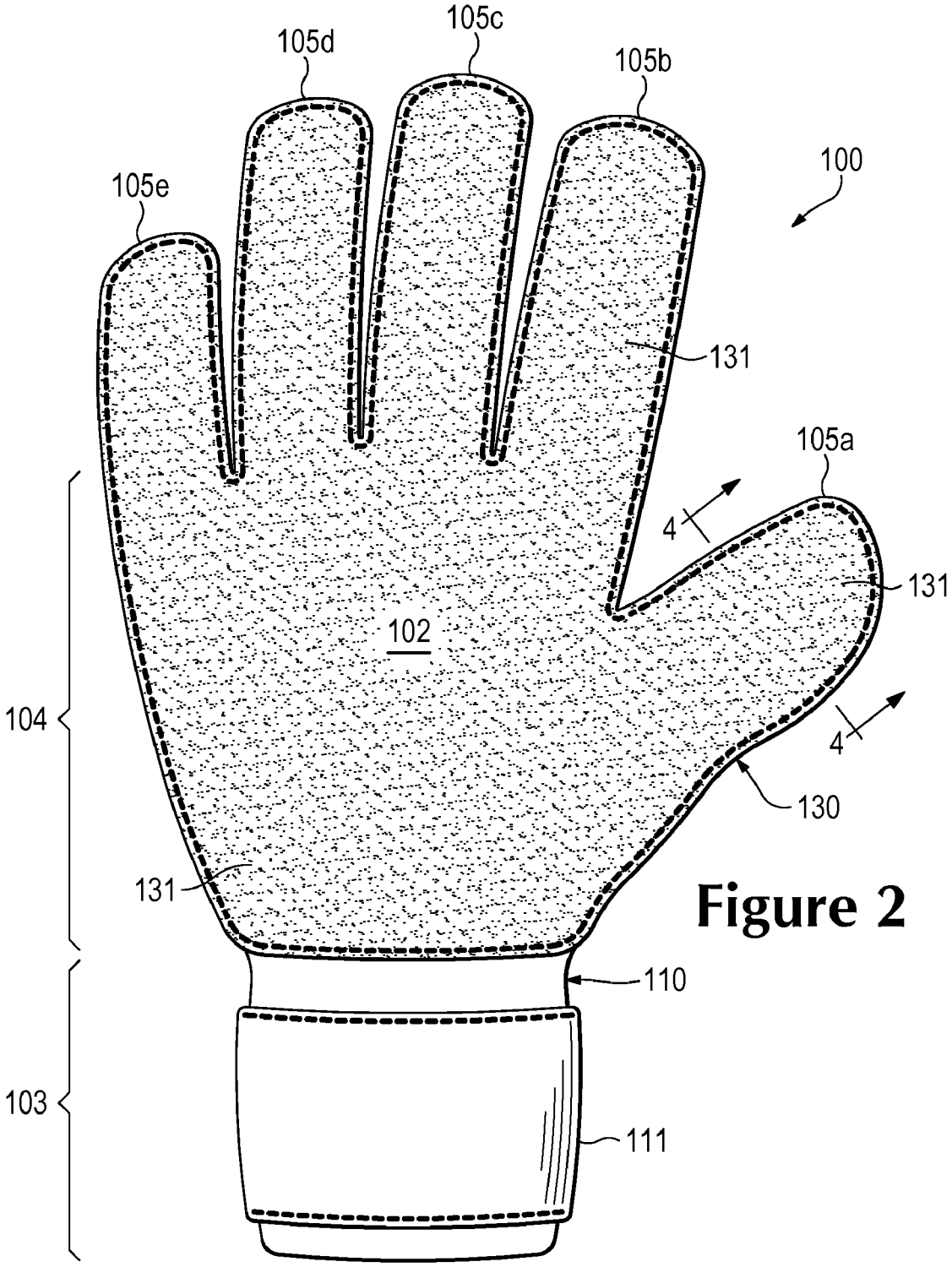
FIG. 2 is a bottom plan view depicting a palmar side of the first glove.

With reference to FIGS. 1 and 2, a glove 100 is depicted as having the configuration of a soccer goalkeeper glove. Glove 100 generally includes a base portion 110, a dorsal element 120, and a palmar element 130. In general, base portion 110 provides a substrate to which dorsal element 120 and palmar element 130 are secured, and base portion 110 forms an interior surface of glove 100 that extends around and contacts a hand of a wearer. Whereas dorsal element 120 forms a majority of a dorsal side 101 of glove 100, which corresponds with a back side of the hand, palmar element 130 forms a majority of a palmar side 102 of glove 100, which corresponds with a palm side of the hand.

Figure 3:
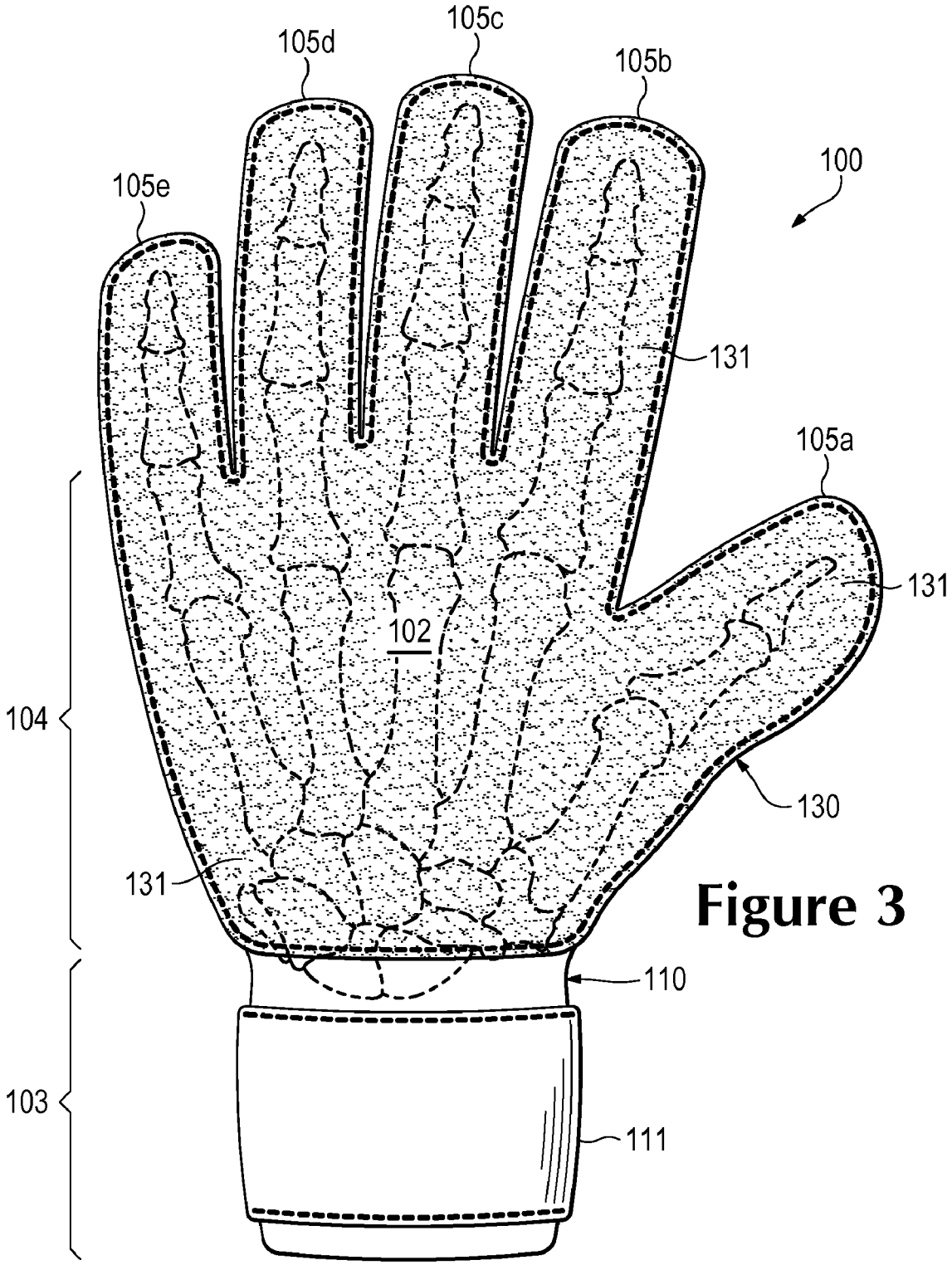
FIG. 3 is a bottom plan view corresponding with FIG. 2 and depicting relative positions of bones of a hand within the first glove.

Referring to FIG. 3, which depicts glove 100 in combination with bones of the hand, glove 100 may be divided into various regions: a wrist region 103, a metacarpal region 104, and five phalangeal regions 105*a*-105*e*. Wrist region 103 generally includes portions of glove 100 corresponding with some of the bones of the wrist and lower portions of the arm. Metacarpal region 104 generally includes portions of glove 100 corresponding with metacarpal bones of the hand. In addition, phalangeal regions 105*a*-105*e* generally includes portions of glove 100 corresponding with the bones of the fingers (i.e., proximal phalanges, middle phalanges, and distal phalanges). More particularly, phalangeal region 105*a* corresponds with the first digit (i.e., the thumb), phalangeal region 105*b* corresponds with the second digit (i.e., the index finger), phalangeal region 105*c* corresponds with the third digit (i.e., the middle finger), phalangeal region 105*d* corresponds with the fourth digit (i.e., the ring finger), and phalangeal region 105*e* corresponds with the fifth digit (i.e., the pinky finger). Regions 103, 104, and 105*a*-105*e* are not intended to demarcate precise areas of glove 100, but are intended to represent general areas of glove 100 to aid in the following discussion. In addition to glove 100, regions 103, 104, and 105*a*-105*e* may also be applied to base portion 110, dorsal element 120, palmar element 130, and individual elements thereof.

Base portion 110 is depicted as having a substantially conventional configuration incorporating a plurality material elements (e.g., textile, polymer sheets, polymer foam, leather, or synthetic leather) that are stitched or adhesively bonded together to form a structure that extends around and contacts the hand. The material elements may be selected and located in order to impart properties of durability, air-permeability, wear-resistance, flexibility, and comfort, for example. Although dorsal element 120 and palmar element 130 form a majority of an exterior of glove 100, base portion 110 is exposed in various areas. More particularly, base portion 110 may be exposed (a) in a majority of wrist region 104 (b) between dorsal element 120 and palmar element 130 in metacarpal region 104, (c) on dorsal side 101 in phalangeal region 105*a*, and (d) between dorsal element 120 and palmar element 130 in phalangeal regions 105*b*-105*e*. In addition, base portion 110 includes an adjustable strap 111 in wrist region 103 that assists with securing glove 100 to the wrist and hand. Although base portion 110 may exhibit the general configuration discussed above and depicted in the figures, base portion 110 may also exhibit the general configuration of practically any other conventional or non-conventional base portion. Accordingly, the overall structure of base portion 110 may vary significantly.

Dorsal element 120 is secured to base portion 110 and forms a majority of dorsal side 101. Referring to FIG. 1, dorsal element 120 covers areas of metacarpal region 104 and phalangeal regions 105*b*-105*e*. In some configurations, dorsal element 120 may also cover portions of wrist region 103 or phalangeal region 105*a*. Suitable materials for dorsal element 120 include a variety of polymer foam materials (e.g., natural latex foam, memory foam, polyurethane foam) that attenuate impact forces. As discussed in the Background section above, the hands of a soccer goalkeeper are susceptible to injury when gaining control of the soccer ball, particularly when the ball is traveling at a relatively high velocity or when other players are attempting to kick or otherwise maneuver the ball. Dorsal element 120, when formed from a polymer foam material, imparts protection to the hands by attenuating impact forces from the ball or the feet of other players when the goalkeeper is attempting to gain control of the soccer ball. In addition to polymer foam materials, a variety of other materials may also be utilized for dorsal element 120 in order to attenuate impact forces, including spacer-knit textiles or other textiles, polymer sheets, molded polymer elements, or fluid-filled members, for example.

Palmar element 130 is secured to base portion 110 and forms a majority (i.e., at least fifty percent) of palmar side 102. Referring to FIG. 2, palmar element 130 is formed as a unitary (i.e., one piece) element that covers areas of metacarpal region 104 and phalangeal regions 105*a*-105*e*. An advantage of forming palmar element 130 to have a unitary configuration is that palmar side 102 may be substantially free of seams that may interfere with the tactile sensation of the goalkeeper. Suitable materials for palmar element 130 include any of the materials discussed above for dorsal element 120, thereby imparting protection to the hands by attenuating impact forces. In addition to protecting the hands, palmar element 130 also imparts grip to assist the goalkeeper with maintaining control of the ball. More particularly, an exterior of palmar element 130 incorporates a silicone material 131 that exhibits a relatively high coefficient of friction with the exterior surface of a soccer ball. The palmar element (and the dorsal element) of many conventional soccer goalkeeper gloves are formed from a natural latex foam material. In comparison with bare natural latex foam materials, silicone material 131 may provide a higher coefficient of friction with the exterior surface of the ball, in both dry and wet conditions. That is, silicone material 131 may provide an enhanced grip over bare natural latex materials in conditions where the ball is dry and in conditions where the ball is wet (e.g., from rain, dew, or mud).

Figure 4:
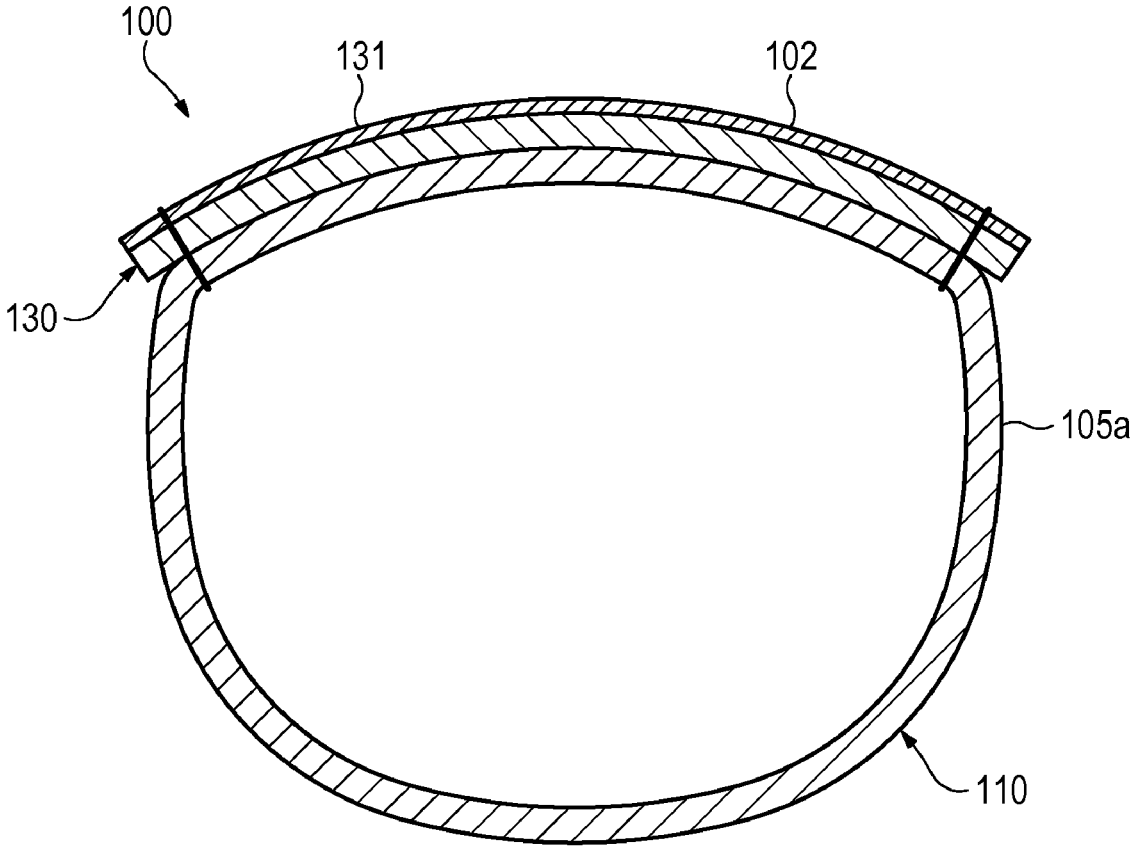
FIG. 4 is a cross-sectional view of the first glove, as defined by section line 4-4 in FIG. 2.

For purposes of identifying the location of silicone material 131 in various figures, silicone material 131 is depicted as having a stippled or otherwise dotted appearance. In general, silicone material is a coating that extends over palmar element 130 and forms a portion of palmar side 102, as depicted in FIGS. 2 and 4. Although silicone material 131 may be directly applied to palmar element 130 (e.g., sprayed or deposited onto palmar element 130), silicone material 131 may also be formed separate from palmar element 130 and subsequently attached to palmar element 130. That is, a sheet of silicone material 131 may be bonded or otherwise secured to a polymer foam material or other material forming palmar element 130.

Figure 5:
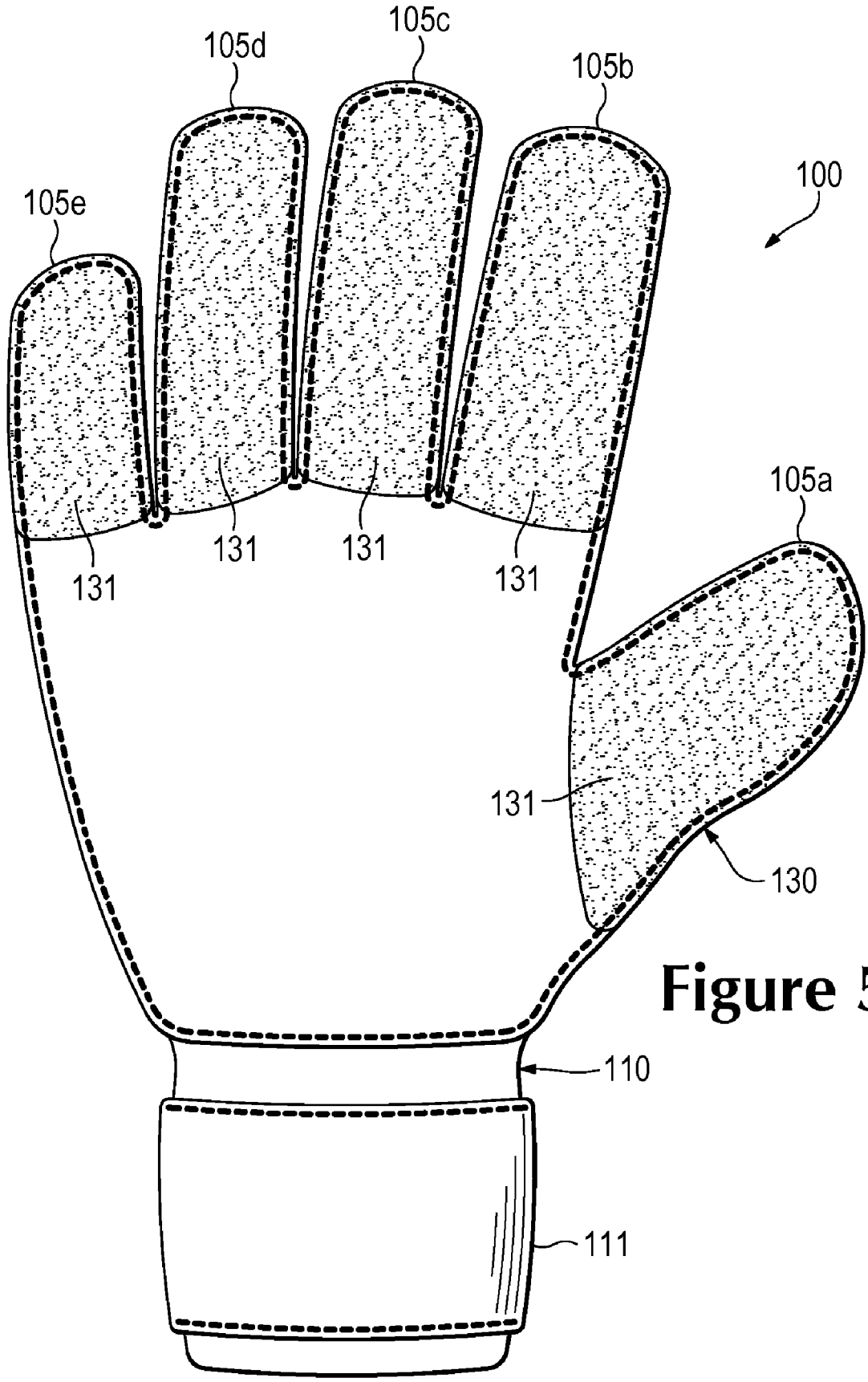
FIGS. 5-10 are bottom plan views depicting further configurations of the first glove.
Figure 6:
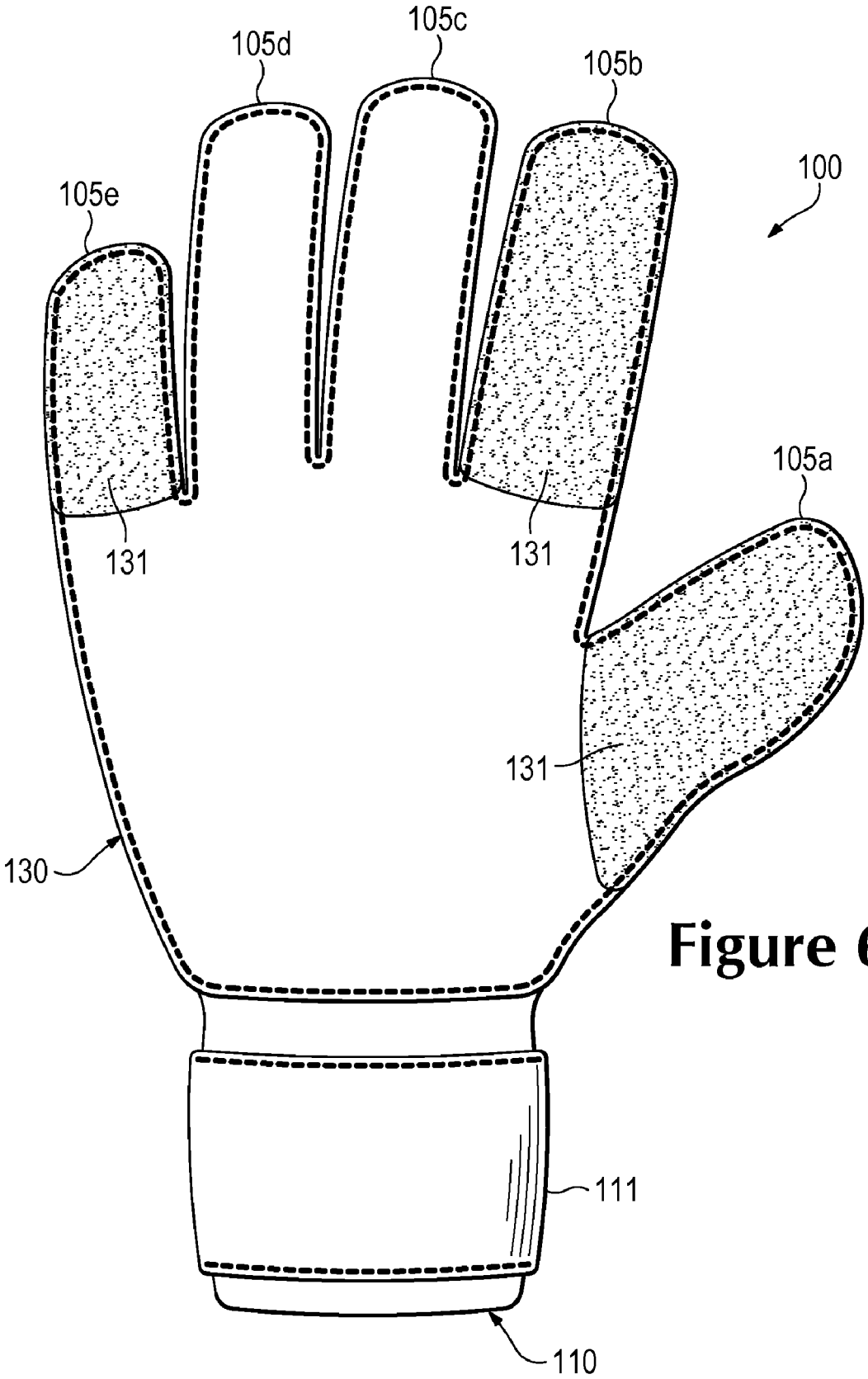
Figure 7:
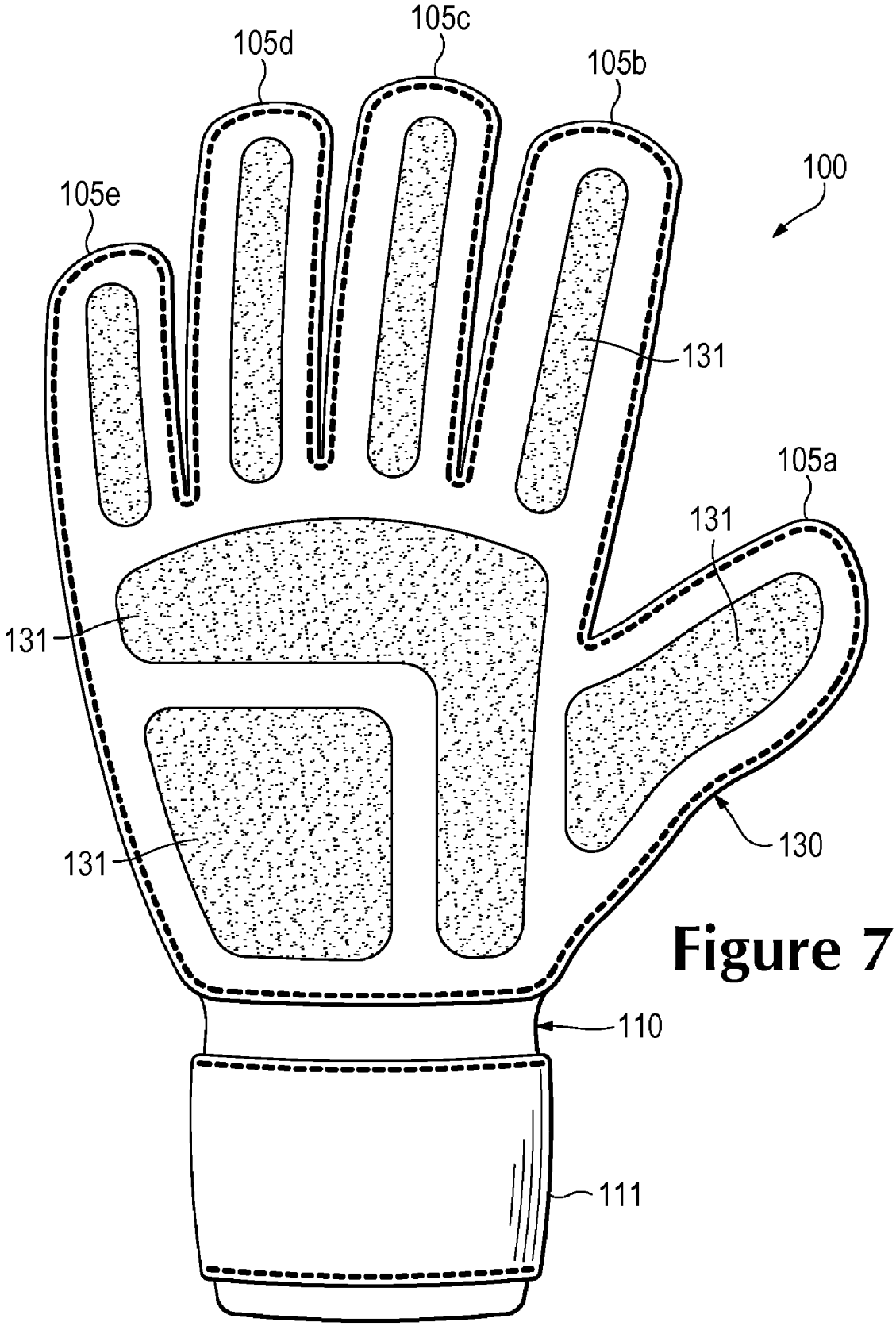
Figure 8:
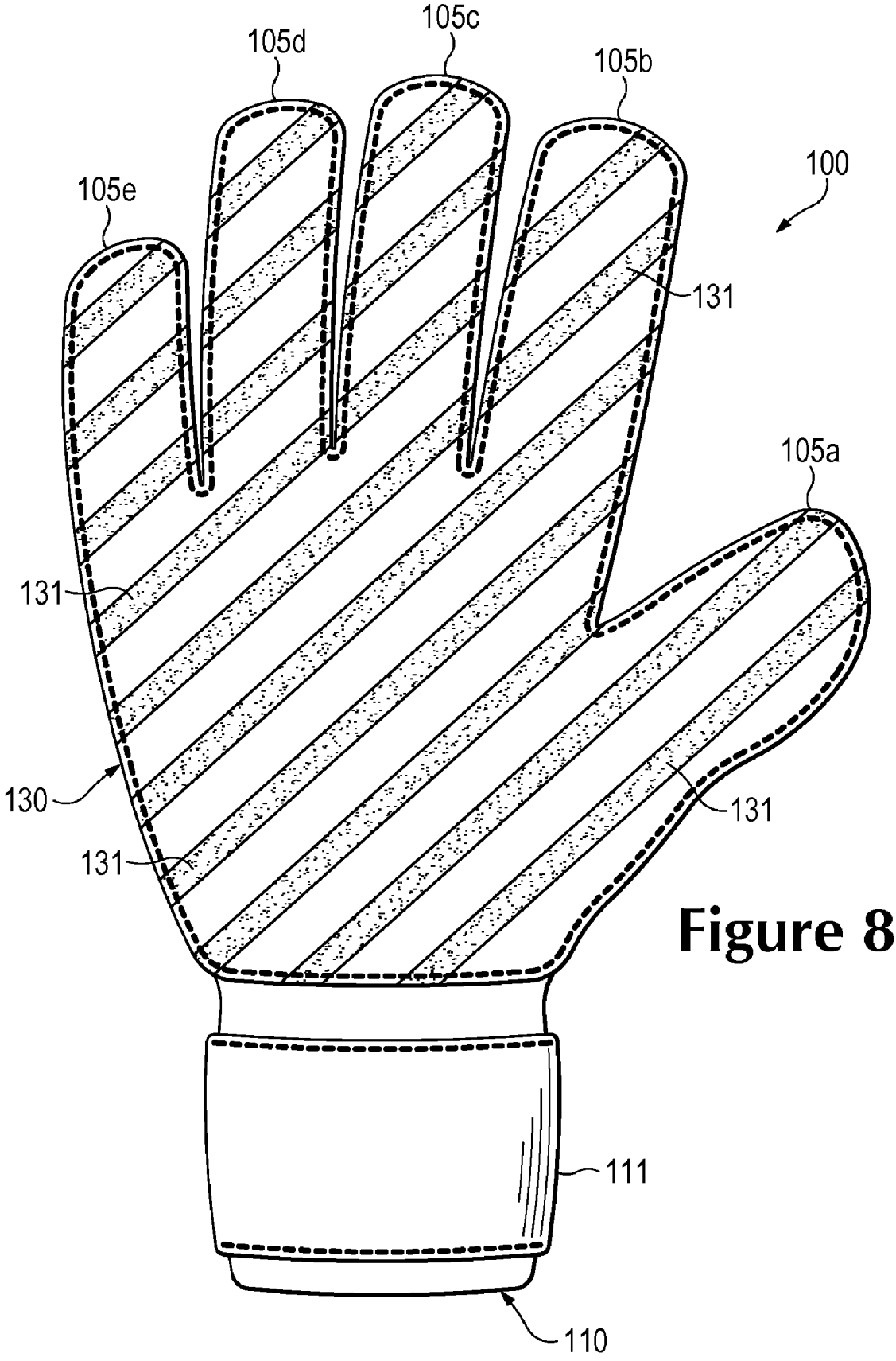
Figure 9:
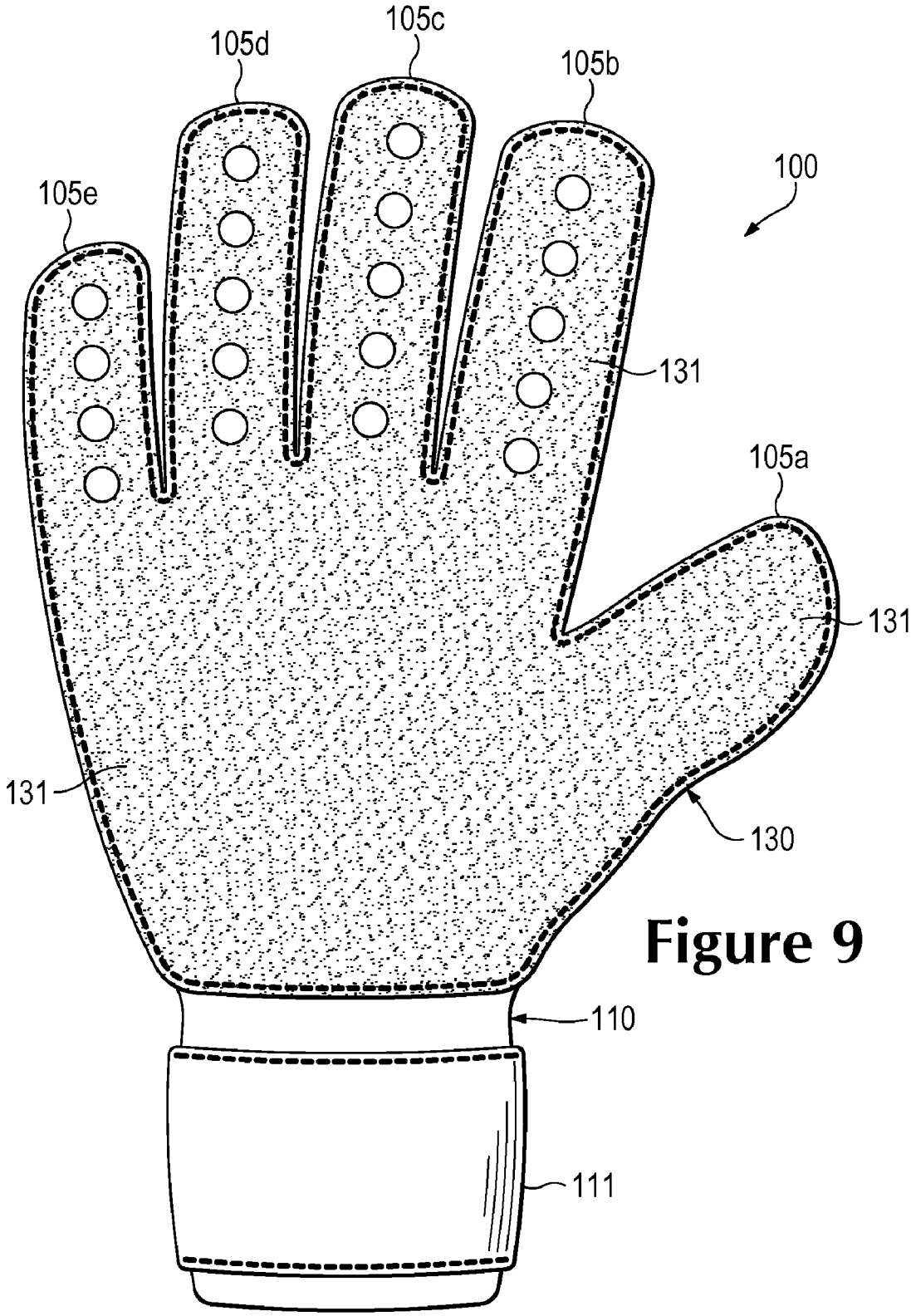
Figure 10:
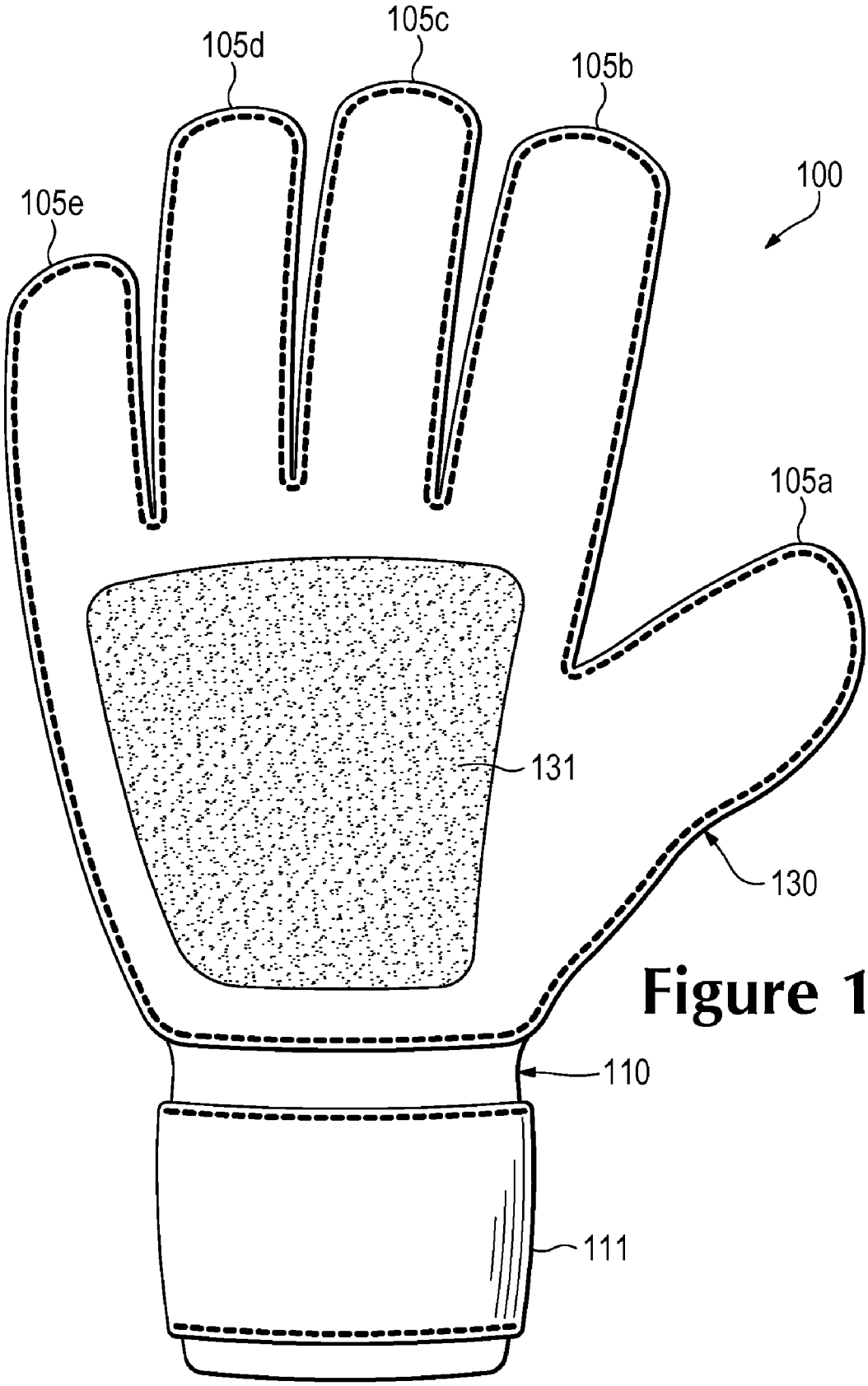

Silicone material 131 is depicted as extending over substantially all of palmar element 130 in FIG. 2 and also depicted as extending between edges of palmar element 130 in FIG. 4. In further configurations of glove 100, however, silicone coating 131 may also be limited to specific areas of palmar element 130 or may also be incorporated into either or both of base portion 110 and dorsal element 120. In order to enhance grip in many configurations of glove 100, silicone material 131 may be (a) located on at least two of phalangeal regions 105*a*-105*e* or (b) applied to at least fifty percent of palmar side 102. Referring to FIG. 5, silicone material 131 is limited to phalangeal regions 105*a*-105*e* and is absent from metacarpal region 104. A similar configuration is depicted in FIG. 6, wherein silicone material 131 is limited to phalangeal regions 105*a*, 105*b*, and 105*e* and is absent from metacarpal region 104 and phalangeal regions 105*c* and 105*d*. In some configurations, silicone material 131 may be applied to discrete areas that expose a surface of the polymer foam material (or other material) of palmar element 130 between the discrete areas, as depicted in FIG. 7. In further configurations, silicone material 131 may be applied in lines that expose a surface of the polymer foam material (or other material) of palmar element 130 between the lines, as depicted in FIG. 8. Silicone material 131 may also define various apertures that expose portions of the polymer foam material (or other material) of palmar element 130, as depicted in FIG. 9. Additionally, silicone material may be limited to metacarpal region 104, as depicted in FIG. 10. Accordingly, the specific areas in which silicone material 131 is located may vary significantly.

Silicone material 131 may be any of a variety of chemical formulations that incorporate silicone. As an example, silicone material 131 may be a cured silicone film layer with a Shore A durometer of less than or equal to 60, as disclosed in U.S. Patent Application Publication 2007/0148409 to Rios, et al., which is incorporated herein by reference. In some configurations, silicone material 131 may be combined with other materials or may have a Shore A durometer of greater than 60. In general, however, silicone material 131 exhibits a relatively high coefficient of friction with the exterior surface of a soccer ball and provides an enhanced grip over bare natural latex materials in conditions where the ball is dry and in conditions where the ball is wet (e.g., from rain, dew, or mud).

Figure 11:
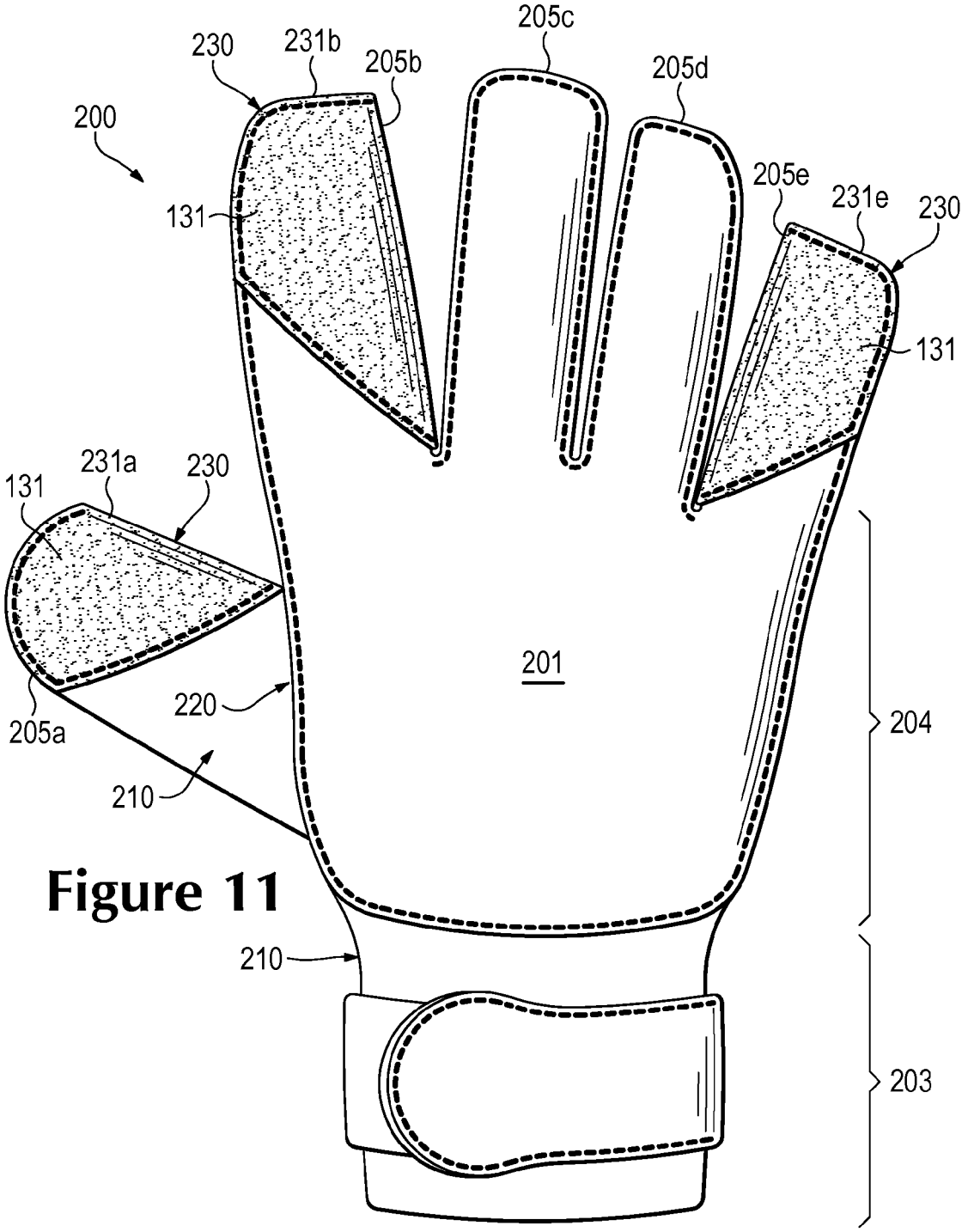
FIG. 11 is top plan view depicting a dorsal side of a second glove.
Figure 12:
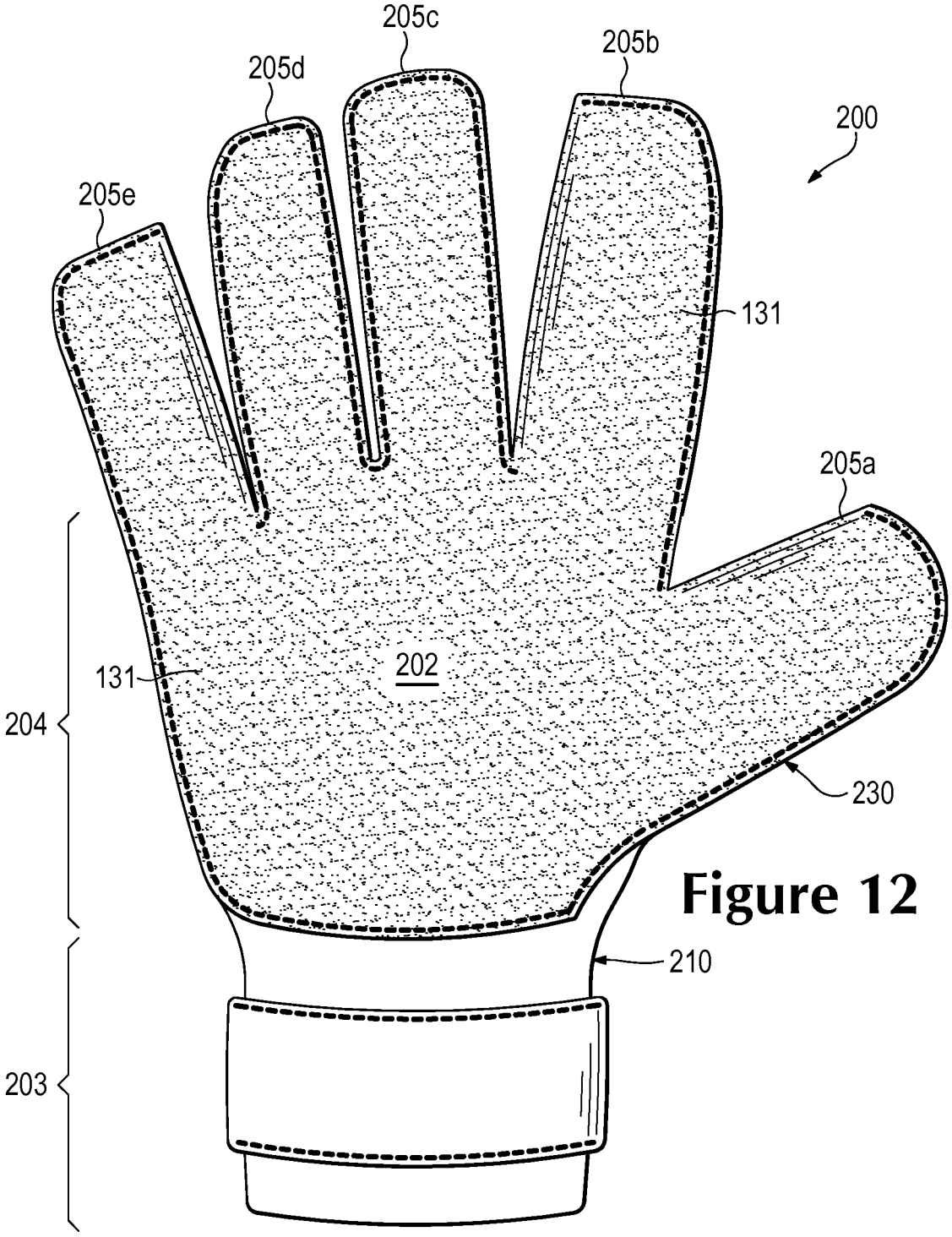
FIG. 12 is a bottom plan view depicting a palmar side of the second glove.

The general configuration of glove 100 discussed above and depicted in FIGS. 1-10 provides an example of a suitable glove that may incorporate silicone material 131. Referring to FIGS. 11 and 12, a glove 200 having a base portion 210, a dorsal element 220, and an opposite palmar element 230 is depicted as having the general configuration disclosed in U.S. Pat. No. 6,654,964 to Staihar, et al., which is incorporated herein by reference. Glove 200 includes a dorsal side 201 and an opposite palmar side 202. In addition, glove 200 includes a wrist region 203, a metacarpal region 204, and five phalangeal regions 205*a*-205*e*. As with glove 100, portions of glove 200 also incorporate silicone material 131. More particularly, silicone material 131 is applied to palmar element 230. Additionally, the material forming palmar element 230 extends from palmar side 202 to dorsal side 201 in phalangeal regions 205*a*, 205*b*, and 205*e*, and silicone material 131 forms at least a portion of an exterior surface of glove 200 on dorsal side 201. That is, silicone material 131 extends from palmar side 202 to dorsal side 201 in phalangeal regions 205*a*, 205*b*, and 205*e*, and a portion of silicone material 131 is located on dorsal side 201.

Figure 13:
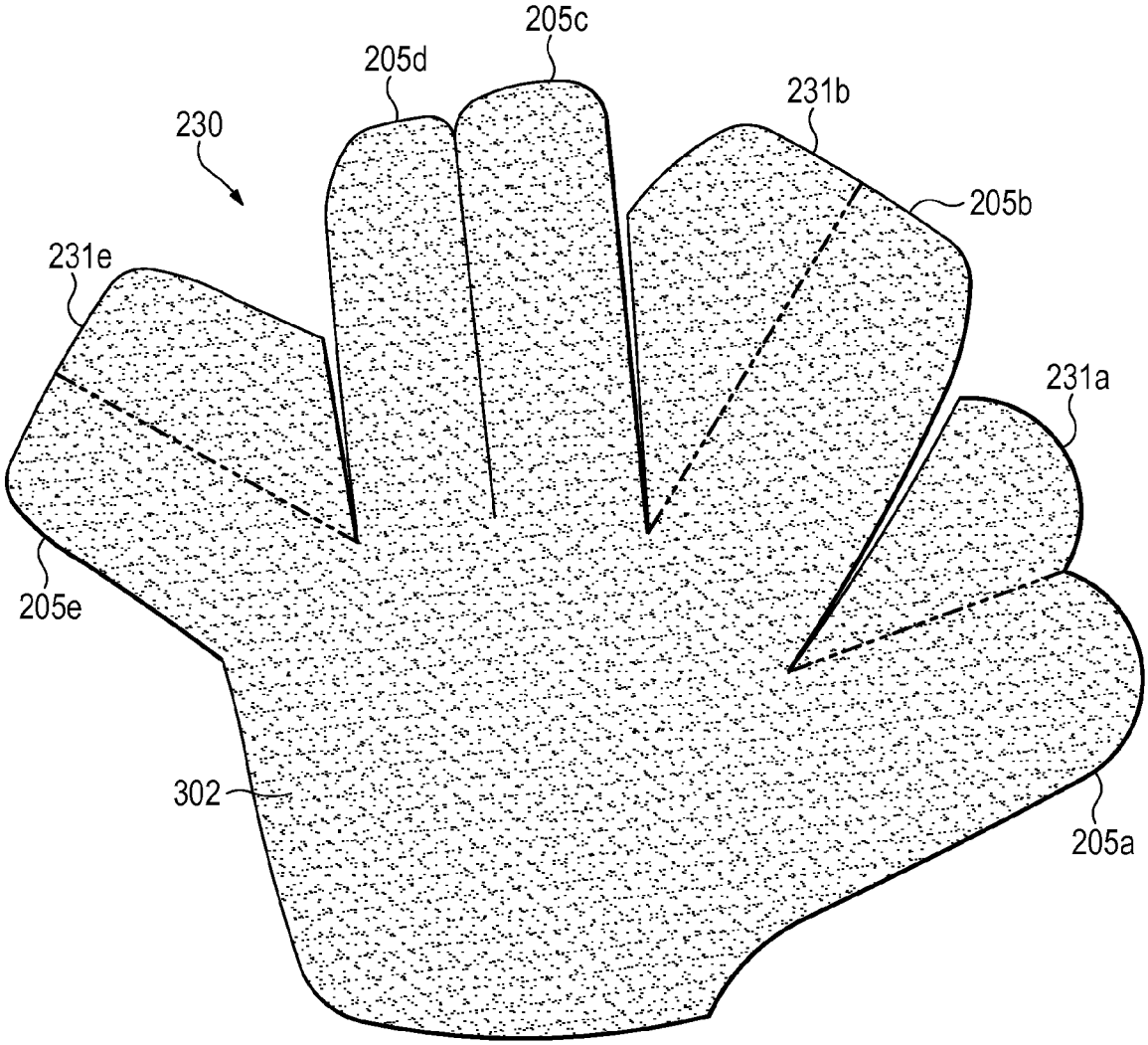
FIG. 13 is a top plan view of a palmar element of the second glove.

Referring to FIG. 13, palmar element 230 is depicted separate from glove 200. In addition to areas that correspond with phalangeal regions 205*a*-205*e*, palmar element 230 includes three regions 231*a*, 231*b*, and 231*e* that respectively extend from phalangeal regions 205*a*, 205*b*, and 205*e*. When incorporated into glove 200, regions 231*a*, 231*b*, and 231*e* wrap around phalangeal regions 205*a*, 205*b*, and 205*e* and form a portion of dorsal side 201, as depicted in FIG. 11. Accordingly, palmar element 230 extends from palmar side 202 to dorsal side 201, and silicone material 131 forms at least a portion of an exterior surface of glove 200 on dorsal side 201.

Moreover, this configuration places a portion of silicone material 131 on sides of phalangeal regions 205*a*, 205*b*, and 205*e*, where contact with the ball may occur. An advantage of this configuration is that silicone material 131 and a seamless portion of palmar element 230 and located on the sides of phalangeal regions 205*a*, 205*b*, and 205*e*, which are used in controlling the ball. In some configurations, this configuration may only be used for each of phalangeal regions 205*a*-205*e*, may be used for only phalangeal region 205*a*, or may be used for only phalangeal regions 205*b* and 205*e*, for example.

Based upon the above discussion, a glove (e.g., a soccer goalkeeper glove) may incorporate materials that attenuate impact forces and provide a relatively high coefficient of friction with a ball. As an example, the glove may include a unitary element of polymer foam material that attenuates impact forces to protect the hands when gaining control of the ball, particularly when the ball is traveling at a relatively high velocity or when other players are attempting to kick or otherwise maneuver the ball. The glove may also include a silicone material or coating that imparts grip to assist with maintaining control of the ball. That is, the silicone material or coating may provide an enhanced grip in conditions where the ball is dry and in conditions where the ball is wet.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A glove for receiving a hand, the glove having a dorsal side corresponding with a back area of the hand and an opposite palmar side corresponding with a palm area of the hand, the palmar side comprising a polymer foam material with a silicone coating, and the silicone coating forming at least a portion of an exterior surface of the glove, wherein the glove has (a) a metacarpal region corresponding with metacarpal bones of the hand and (b) five phalangeal regions corresponding with phalanx bones of the hand, the polymer foam material is located within each of the metacarpal region and the five phalangeal regions, the silicone coating is located in at least two of the five phalangeal regions, and the silicone coating is absent from the metacarpal region.

2. The glove recited in claim 1, wherein the silicone coating is a cured silicone film layer with a Shore A durometer of less than or equal to 60.

3. The glove recited in claim 1, wherein the silicone coating defines a plurality of apertures that expose a surface of the polymer foam material.

4. The glove recited in claim 1, wherein the silicone coating is applied to discrete areas that expose a surface of the polymer foam material between the discrete areas.

5. The glove recited in claim 1, wherein the silicone coating is applied in lines that expose a surface of the polymer foam material between the lines.

6. The glove recited in claim 1, wherein the silicone coating forms at least fifty percent of the exterior surface of the palmar side.

7. The glove recited in claim 1, wherein the polymer foam material extends from the palmar side to the dorsal side of the glove, and the silicone coating forms at least a portion of an exterior surface of the dorsal side.

8. A glove for receiving a hand, the glove having a dorsal side corresponding with a back area of the hand and an opposite palmar side corresponding with a palm area of the hand, and the glove having (a) a metacarpal region corresponding with metacarpal bones of the hand and (b) five phalangeal regions corresponding with phalanx bones of the hand, the palmar side comprising:

a unitary element of polymer foam material located within each of the metacarpal region and the five phalangeal regions; and a silicone material that is joined to the polymer foam material and forms at least a portion of an exterior surface of the palmar side, wherein the silicone material is located in at least two of the five phalangeal regions, and the silicone material is absent from the metacarpal region.

9. The glove recited in claim 8, wherein the silicone coating is a cured silicone film layer with a Shore A durometer of less than or equal to 60.

10. The glove recited in claim 8, wherein the silicone material forms at least fifty percent of the exterior surface of the palmar side.

11. The glove recited in claim 8, wherein the polymer foam material extends from the palmar side to the dorsal side of the glove in at least one of the five phalangeal regions, and the silicone material forms at least a portion of an exterior surface of the dorsal side.

* * * * *